US008205550B2

(12) United States Patent
Binder et al.

(10) Patent No.: US 8,205,550 B2
(45) Date of Patent: Jun. 26, 2012

(54) METHOD FOR OPERATING AN ANILOX PRINTING UNIT AND PRINTING PRESS FOR CARRYING OUT THE METHOD

(75) Inventors: Gisela Binder, Schwetzingen (DE); Suat Demir, Walldorf (DE); Jürgen Michels, Dossenheim (DE); Dieter Schaffrath, Lorsch (DE); Jörg Schilfahrt, Mauer (DE); Wolfgang Schönberger, Schriesheim (DE); Bernhard Schwaab, Neustadt (DE); Michael Thielemenann, Heildelberg (DE)

(73) Assignee: Heidelberger Druckmaschinen AG, Heidelberg (DE)

( * ) Notice: Subject to any disclaimer, the term of this patent is extended or adjusted under 35 U.S.C. 154(b) by 792 days.

(21) Appl. No.: 11/950,604

(22) Filed: Dec. 5, 2007

(65) Prior Publication Data

US 2008/0127840 A1 Jun. 5, 2008

(30) Foreign Application Priority Data

Dec. 5, 2006 (DE) ..... 102006057252

(51) Int. Cl.
*B41F 31/06* (2006.01)
*B41F 33/00* (2006.01)

(52) U.S. Cl. ..... 101/352.13; 101/350.6; 101/351.1

(58) Field of Classification Search ..... 101/350.6, 101/350.5, 351.1, 351.3, 352.04, 352.13, 101/154, 157, 169
See application file for complete search history.

(56) References Cited

U.S. PATENT DOCUMENTS

| | | | | |
|---|---|---|---|---|
| 5,400,710 | A * | 3/1995 | Ehrhard | 101/363 |
| 5,749,293 | A * | 5/1998 | Ota et al. | 101/157 |
| 6,024,015 | A * | 2/2000 | Dillig et al. | 101/350.5 |
| 6,523,469 | B2 * | 2/2003 | Bayer et al. | 101/350.6 |
| 6,672,208 | B2 * | 1/2004 | Bechtler et al. | 101/351.1 |
| 2002/0073866 | A1 | 6/2002 | Bechtler et al. | |
| 2002/0162466 | A1 * | 11/2002 | Schonberger | 101/350.3 |

* cited by examiner

*Primary Examiner* — Judy Nguyen
*Assistant Examiner* — Leo T Hinze
(74) *Attorney, Agent, or Firm* — Laurence A. Greenberg; Werner H. Stemer; Ralph E. Locher

(57) ABSTRACT

A method of operating an anilox printing unit in which ink accumulates on and detaches from a feed blade and, after detaching from the feed blade, forms ink accumulations on a screen roller, and in which a gap is formed between the screen roller and a further roller for the ink accumulations to pass through the gap without contacting the further roller, includes forming the gap by displacing the axis of the further roller and evening out the ink accumulations on the screen roller to such an extent that the ink accumulations that have been evened out pass the gap without contacting the further roller. A smoothing roller, for example, may be used to even out the ink accumulations. A printing press for carrying out the method is also provided.

12 Claims, 2 Drawing Sheets

METHOD FOR OPERATING AN ANILOX PRINTING UNIT AND PRINTING PRESS FOR CARRYING OUT THE METHOD

CROSS-REFERENCE TO RELATED APPLICATION

This application claims the priority, under 35 U.S.C. §119, of German Patent Application DE 10 2006 057 252.1, filed Dec. 5, 2006; the prior application is herewith incorporated by reference in its entirety.

BACKGROUND OF THE INVENTION

Field of the Invention

The present invention relates to a method for operating an anilox printing unit in which ink accumulates on and detaches from a feed blade and forms ink accumulations on a screen roller after detaching from the feed blade, and in which a gap is formed between the screen roller and a further roller, through which the ink accumulations pass without contacting the further roller.

German Published, Non-Prosecuted Patent Application DE 102 53 194 A1 describes such a method. In the prior art method, the further roller has a circumferential-side tensioning gap in which a clamping device for a printing blanket is located. Every time the tensioning gap faces the screen roller in the course of the rotation of the further roller, a gap is formed between the screen roller and the further roller for the ink accumulations to pass through. Together, the lower side of the feed blade and the circumferential surface of the screen roller form a wedge into which a blower device is directed. The blower device is used to detach ink accumulating on the underside of the feed blade from the feed blade in a controlled manner. The detached ink forms ink accumulations on the screen roller that are conveyed through the gap between the rollers due to the rotation of the screen roller without contacting the further roller. In the course of the further rotation of the screen roller, the latter conveys ink accumulations into an ink chamber attached to the feed blade and containing an ink supply. The ink chamber is associated with the screen roller and disposed in the region of the upper half of the screen roller. Consequently, there is no danger that the ink detaching from the feed blade may drip onto the blower device.

However, in other known ink supply systems, for instance in the ink system disclosed in German Published, Non-Prosecuted Patent Application DE 10 2005 049 090 A1, corresponding to Canadian Patent Application CN 1 772 481 A, the ink chamber with the feed blade is associated with the screen roller and disposed in the region of the lower half of the screen roller. When a blower device as described in the aforementioned prior art (German Published, Non-Prosecuted Patent Application DE 102 53 194 A1) is used in an ink supply system of that type, which is also known as a blade ink fountain, there is a risk that the ink detaching from the lower side of the feed blade may drip onto the blower device and contaminate the latter in such a way that its functioning is affected.

BRIEF SUMMARY OF THE INVENTION

It is accordingly an object of the invention to provide a method for operating an anilox printing unit and a printing press for carrying out the method, which overcome the hereinafore-mentioned disadvantages of the heretofore-known methods and devices of this general type and which are suitable for an anilox printing unit with a feed blade disposed in a region of a lower half of a screen roller.

With the foregoing and other objects in view there is provided, in accordance with the invention, a method for operating an anilox printing unit. The method comprises providing a screen roller and a further roller having axis, and providing a feed blade on which ink accumulates and from which ink detaches forming ink accumulations on the screen roller after detaching from the feed blade. A gap is formed between the screen roller and the further roller by displacement of the axis of the further roller. The ink accumulations on the screen roller are evened out to such an extent that the ink accumulations that have been evened out pass through the gap without contacting the further roller.

In accordance with the invention, the method includes generating the gap by disengaging the further roller from the screen roller by displacing the axis of rotation of the further roller. Thus, the further roller does not need a circumferential-side gap to form the gap between the rollers. If the further roller nevertheless has such a gap for other reasons, this gap may be kept especially small. In accordance with the method of the invention, the ink accumulations, which are substantially drop-shaped or thread-shaped, are smoothed out by squeezing them and/or by partially ablating them so that the ink accumulations can subsequently be conveyed on the rotating screen roller through the gap without contacting the further roller. The method according to the invention does not require the feed blade to be positioned in a specific circumferential position relative to the circumference of the screen roller and is particularly suitable for anilox printing units in which the feed blade rests against the screen roller in the region of the lower half of the screen roller, i.e. in the region of the third or fourth quadrant of the screen roller.

In accordance with the two further developments that will be explained firstly below, it should be noted that a particularly critical operating phase is a restart of the anilox printing unit and a restart of the rotation of the screen roller after a standstill of the machine or an interruption of the printing operation because in this situation, the ink drops or threads accumulated on the outer side of the feed blade and, forming what is known as an ink beard, have a particularly strong tendency to be torn from the feed blade and entrained by the screen roller.

In accordance with another mode of the invention, during the restart of the screen roller, the further roller is disengaged from the screen roller to such an extent that the gap between the further roller and the screen roller is large enough for the ink accumulations that have been evened out to pass through this gap without contacting the further roller.

In accordance with a further mode of the invention, during a restart of the rotation of the screen roller, the ink accumulations present on the screen roller are flattened to such an extent that the height of the flattened ink accumulations is smaller than the gap-defining distance between the screen roller and the further roller. Thus, the ink accumulations can be conveyed through the gap without colliding with the further roller.

In accordance with an added mode of the invention, a smoothing device for smoothing or evening out the ink accumulations on the screen roller is disposed between the feed blade and the screen roller, as viewed along the circumferential line of the screen roller. As viewed in the direction of rotation of the screen roller, the smoothing device is disposed downstream of the feed blade and upstream of the further roller or the gap.

In accordance with an additional mode of the invention, the smoothing device is constructed as a smoothing blade. This smoothing blade is not identical with the operating or feed blade or a closing blade. An operating or feed blade is a component of the ink feed system that is associated with the screen roller and may be a blade ink fountain or a chambered doctor blade. The operating or feed blade is used to strip off excess ink on the screen roller during the feeding operation of the ink feed system so that the excess ink remains in the ink feed system. If the ink feed system is constructed as a chambered doctor blade, the latter includes a closing blade in addition to the operating or feed blade. The ink chamber is located between those two blades. In contrast, the smoothing blade has a different function, which is completely or at least sufficiently to even out the ink accumulations that are formed on the screen roller after the ink has been fed in. In the process of evening out the ink accumulations, the smoothing blade takes off the upper part of each ink accumulation and flattens the remaining part. Both effects contribute to reducing the height of the ink accumulations to a sufficient degree. Depending on various parameters such as the Theological properties of the printing ink, one effect or the other may be predominant.

In accordance with yet another mode of the invention, during the evening out of the ink accumulations, there is a distance between the edge of the smoothing blade and the circumferential surface of the screen roller, and this distance is greater than the distance between the edge of the feed blade and the circumferential surface of the screen roller. The latter distance between the feed blade and the screen roller is substantially zero as the feed roller rests against the screen roller. The smoothing blade does not rest against the screen roller. The distance between the edge of the smoothing blade and the circumferential surface of the screen roller may, for example, be approximately 0.4 mm.

In accordance with yet a further mode of the invention, during the evening out of the ink accumulations, there is a distance between the edge of the smoothing blade and the circumferential surface of the screen roller, and this distance is smaller than the distance between the circumferential surface of the screen roller and the circumferential surface of the further roller when the further roller is disengaged from the screen roller. The distance between the smoothing blade edge and the circumferential surface of the screen roller is consequently smaller than the gap through which the ink accumulations pass.

In accordance with yet an added mode of the invention, ink residues that accumulate on the smoothing blade and run off the latter are collected in a trough or similar container. The upper parts of the ink accumulations that have been stripped off by the smoothing blade form the ink residues that accumulate on the smoothing blade.

In accordance with yet an additional mode of the invention, the smoothing device is constructed as a smoothing roller. This smoothing roller preferably has a rubber-elastic circumferential area, i.e. it is what is known as a rubber roller.

In accordance with again another mode of the invention, the smoothing roller is brought into engagement with the screen roller depending on the disengagement of the further roller from the screen roller. Thus, the smoothing roller is in engagement with the screen roller when the further roller is disengaged from the screen roller, for example during the aforementioned restarting phase of the screen roller. During the printing operation following the restarting phase, the smoothing roller is again disengaged from the screen roller and the further roller again rests against the screen roller. An electronic control unit may be provided for automatically initiating the engagement and disengagement of the smoothing roller with and from the screen roller. The ink accumulations present on the screen roller are evened out as the smoothing roller rolls over the ink accumulations. In the process, the ink forming the ink accumulations may be split between the circumferential surfaces of the smoothing roller and the screen roller as they roll off on each other, so that the parts of the ink accumulations that are taken off the screen roller by the smoothing roller are retransferred from the smoothing roller to the screen roller at circumferential locations of the screen roller that are offset in the circumferential direction with respect to the circumferential locations on which the remaining parts of the ink accumulations are located on the screen roller.

With the objects of the invention in view, there is concomitantly provided a printing press that is suitable for implementing the method according to the invention or one of the further developments thereof. The anilox printing unit of this printing press is equipped with the aforementioned smoothing device, for example in the form of a smoothing blade or roller.

Other developments of the invention that are advantageous in structural and functional terms will become apparent from the following description of two exemplary embodiments and the associated drawings. Other features which are considered as characteristic for the invention are set forth in the appended claims.

Although the invention is illustrated and described herein as embodied in a method for operating an anilox printing unit and a printing press for carrying out the method, it is nevertheless not intended to be limited to the details shown, since various modifications and structural changes may be made therein without departing from the spirit of the invention and within the scope and range of equivalents of the claims.

The construction and method of operation of the invention, however, together with additional objects and advantages thereof will be best understood from the following description of specific embodiments when read in connection with the accompanying drawings.

DETAILED DESCRIPTION OF THE INVENTION

Figure 1:
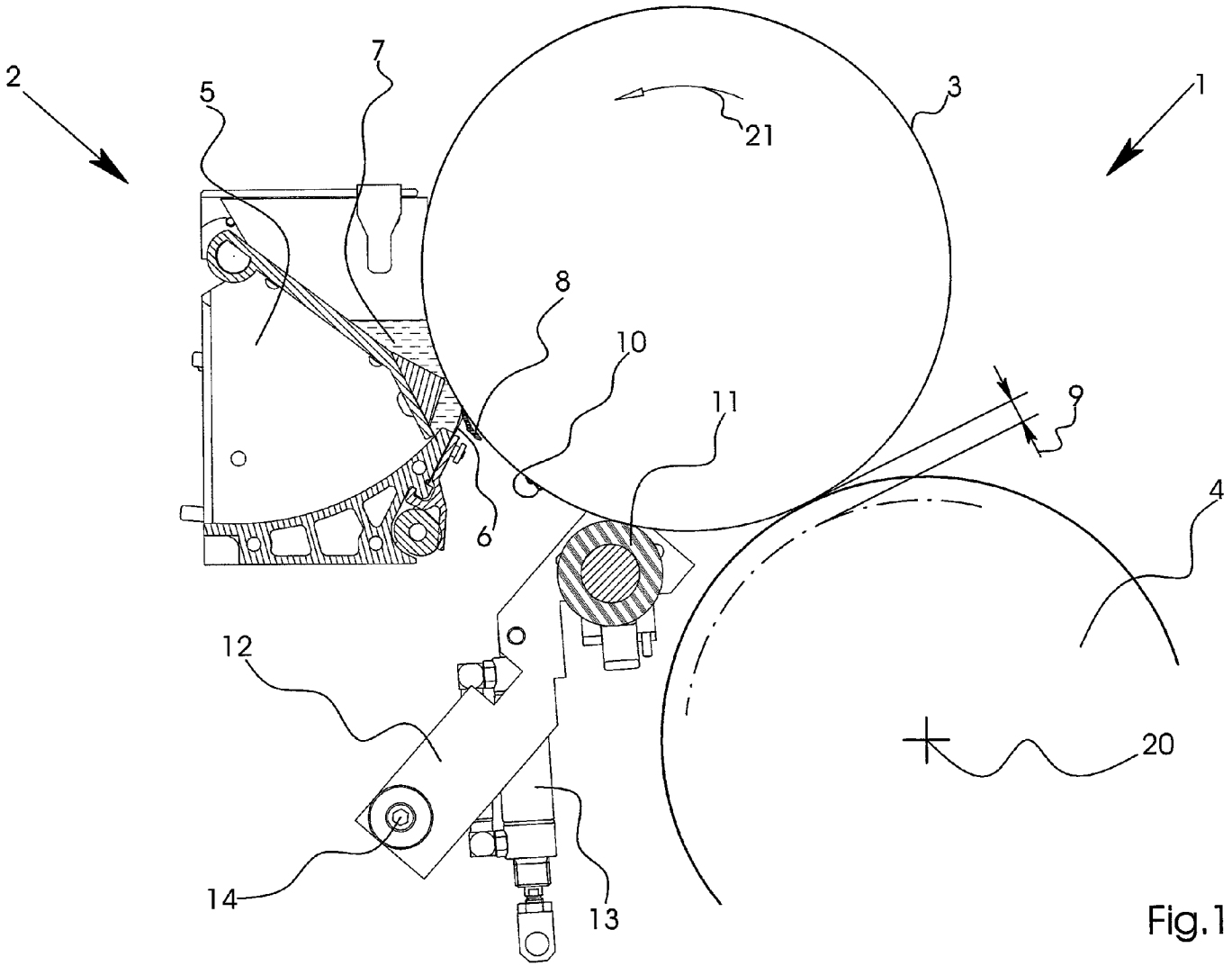
FIG. 1 is a fragmentary, diagrammatic, cross-sectional view of a first exemplary embodiment of the invention in which a smoothing device is constructed as a smoothing roller.
Figure 2:
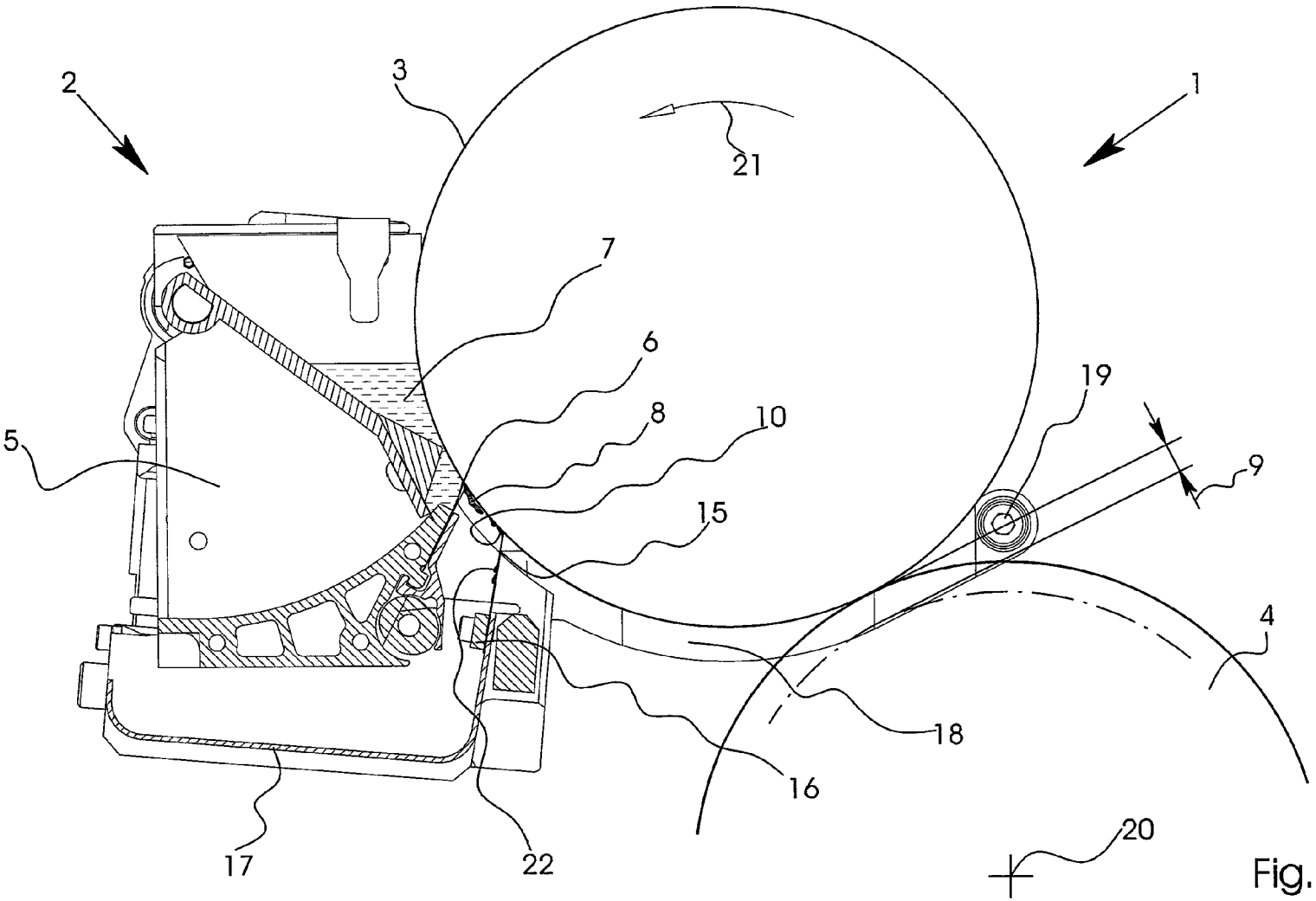
FIG. 2 is a view similar to FIG. 1 of a second exemplary embodiment of the invention in which the smoothing device is constructed as a smoothing blade.

Referring now in detail to FIGS. 1 and 2 of the drawings as a whole, there are seen respective sections of a printing press 1 including an anilox printing unit 2. The anilox printing unit 2 is a lithographic offset printing unit and includes a screen roller 3 and a further roller 4 to which printing ink is transferred by the screen roller 3. The further roller 4 is an ink applicator roller that rolls on a non-illustrated plate cylinder during a printing operation.

The screen roller 3 is associated with an ink supply system in the form of a blade ink fountain 5 that is open at the top and has a negative operating or feed blade 6. The blade ink fountain 5 contains an ink supply 7. The feed blade 6 rests against the screen roller, in the lower half of the screen roller 3, in the region of the third quadrant of the screen roller 3.

Ink cannot be prevented from accumulating on the outer or lower side of the feed blade 6 over the course of an operating period. This accumulating ink forms what may be referred to as an ink beard 8 due to the friction exerted by the circumferential surface of the rotating screen roller 3. When the screen roller 3 restarts to rotate at an increasing speed in a direction of rotation 21 after a standstill of the machine or an interruption of the printing operation, the ink beard 8 has a tendency to be torn off the feed blade 6 in one large piece or, more frequently, in many small pieces. The ink that has been torn off forms ink accumulations 10 on the circumferential surface of the screen roller 3, for example in the shape of a row of drops.

Although the further roller 4 is still disengaged from the screen roller 3 in this critical operating phase, the ink accumulations 10 are so high that, without the countermeasures in accordance with the invention, the ink accumulations 10 would collide with the further roller 4 as the ink accumulations 10 pass through a gap 9 formed by the screen roller 3 and the further roller 4. In the process, parts of the ink accumulations 10 would be transferred from the screen roller 3 to the ink applicator roller 4, thus causing flaws that would be visible in the printed image on the printed sheet.

The gap 9 is formed by displacing the further roller 4 together with its geometric axis of rotation 20 away from the screen roller 3. In FIGS. 1 and 2, the circumferential line of the further roller 4 in a position in which the further roller 4 is engaged with the screen roller 3 is shown in full lines and the position in which the further roller 4 is disengaged from the screen roller 3 is shown in phantom lines.

In accordance with the invention, a countermeasure is carried out to even out or smooth the ink accumulations 10 before the latter pass through the gap 9. A smoothing device is provided for the smoothing operation downstream of the blade ink fountain 5 and upstream of the gap 9, as viewed in the direction of rotation 21.

In the exemplary embodiment shown in FIG. 1, the smoothing device includes a smoothing roller 11, which is supported in a pivot lever 12 so as to be capable of rotating. The pivot lever 12 is pivotable about a joint 14 through the use of an actuator 13. The smoothing roller 11 can thus be engaged with and disengaged from the screen roller 3 through the use of the actuator 13, which may, for example, be a pneumatic operating cylinder.

An electronic control device of the printing press 1 actuates a non-illustrated device for engaging and disengaging the further roller 4 with and from the screen roller 3 and the actuator 13 in such a way that in the operating phase of a restart of the rotation of the screen roller 3, the further roller 4 is disengaged from the screen roller 3 and the smoothing roller 11 is engaged with the screen roller 3. In the continuous printing phase following the restarting phase, the further roller 4 is engaged with the screen roller 3 and the smoothing roller 11 is disengaged from the screen roller 3. The electronic control device is programmed in a corresponding way.

When the smoothing roller 11 rests against the screen roller 3, the rotation of the smoothing roller 11 is exclusively driven by the circumferential surface of the screen roller 3 through friction.

As the smoothing roller 11 rolls over the ink accumulations 10, the ink accumulations 10 are flattened. As the screen roller 3 continues to rotate, the ink relief that has thus been created on the circumferential surface of the screen roller 3 after the flattening of the ink accumulations passes through the gap 9 without smearing off on the further roller 4.

In the exemplary embodiment shown in FIG. 2, the smoothing device is constructed as a smoothing blade 15, which is attached to a trough 17 through the use of a clamping bar 16. The trough 17 is supported by a pivot arm 18, which is pivotable about a joint 19. The trough 17, together with the smoothing blade 15, can be pivoted away from the screen roller 3 into a maintenance position so that these parts are easily accessible for cleaning purposes.

The smoothing blade 15 does not rest against the circumferential surface of the screen roller 3. Instead, there is a distance between the tip or edge of the smoothing blade 15 and the circumferential surface of the screen roller 3. This distance is smaller than the width of the gap 9 and smaller than the height of the ink accumulations 10. Consequently, the ink accumulations 10 are partly stripped off and partly smoothed by the smoothing roller 15 as the ink accumulations 10 pass the smoothing blade 15. After being evened out, the height of the ink accumulations 10 is smaller than the width of the gap 9, thus ensuring that the ink accumulations 10 pass through the gap 9 without contacting the further roller 4.

As the ink accumulations 10 are stripped off, the stripped-off part forms ink residues 22 on the smoothing blade 15. These ink residues 22 run or drip off into the trough 17, where they are temporarily stored. Since the ink residues 22 have a low volume, it takes a relatively long time for the trough 17 to reach its maximum filling level and to require emptying. For example, the trough 17 may be emptied routinely as part of the weekly cleaning of the printing press 1.

The invention claimed is:

1. A method for operating an anilox printing unit, the method comprising the following steps:

providing a screen roller and a further roller having axis;

providing a negative feed blade resting against the screen roller, on which negative feed blade ink accumulates and from which negative feed blade ink detaches forming ink accumulations on the screen roller after detaching from the negative feed blade;

forming a gap between the screen roller and the further roller by displacement of the axis of the further roller; and evening out the ink accumulations on the screen roller to such an extent that the ink accumulations that have been evened out pass through the gap without contacting the further roller.

2. The method according to claim 1, which further comprises, during a restart of the screen roller, disengaging the further roller from the screen roller to such an extent that the gap is formed through which the ink accumulations that have been evened out are capable of passing.

3. The method according to claim 1, which further comprises, during a restart of the screen roller, evening out the ink accumulations on the screen roller to such an extent that the ink accumulations that have been evened out pass through the gap without contacting the further roller.

4. The method according to claim 1, which further comprises providing a smoothing device downstream of the feed blade and upstream of the further roller in direction of rotation of the screen roller, and carrying out the step of evening out the ink accumulations with the smoothing device.

5. The method according to claim 4, wherein the smoothing device is a smoothing blade.

6. The method according to claim 5, which further comprises placing the smoothing blade further away from the screen roller than the feed blade, as the ink accumulations are evened out by the smoothing blade.

7. The method according to claim 6, which further comprises placing the smoothing blade closer to the screen roller than the further roller, during the evening out of the ink accumulations by the smoothing blade.

8. The method according to claim 5, which further comprises placing the smoothing blade closer to the screen roller than the further roller, during the evening out of the ink accumulations by the smoothing blade.

9. The method according to claim 5, which further comprises collecting, in a trough, ink residues accumulating on and running off the smoothing blade.

10. The method according to claim 4, wherein the smoothing device is a smoothing roller.

11. The method according to claim 10, which further comprises engaging the smoothing roller with the screen roller in dependence on a disengagement of the further roller from the screen roller.

12. A printing press, comprising an anilox printing unit for carrying out the method according to claim 1.

* * * * *